United States Patent [19]

Smith, Jr.

[11] Patent Number: 4,972,541

[45] Date of Patent: Nov. 27, 1990

[54] FEATHER DUSTER HAVING A FAN ASSEMBLY

[76] Inventor: O. K. Smith, Jr., 112 Baker Rd., Martin, Tenn. 38237

[21] Appl. No.: 453,909

[22] Filed: Dec. 20, 1989

[51] Int. Cl.[5] ..... A47L 9/02

[52] U.S. Cl. ..... 15/105; 15/344; 15/347; 15/348; 15/412; 15/234

[58] Field of Search ..... 15/234, 97 R, 344, 347, 15/348, 349, 380, 383, 105, 412

[56] References Cited

U.S. PATENT DOCUMENTS

| | | | |
|---|---|---|---|
| 1,040,176 | 10/1912 | Eichele | 15/234 |
| 2,124,989 | 9/1940 | Brand | 15/234 |
| 2,972,160 | 2/1961 | Hahn | 15/344 |
| 2,984,852 | 5/1961 | George | 15/234 |
| 3,903,564 | 9/1975 | Morinaga | 15/344 |

*Primary Examiner*—Ernest G. Cusick
*Attorney, Agent, or Firm*—T. M. Gernstein

[57] ABSTRACT

A feather duster includes a fan assembly and a dust catching assembly and a turbulence-inducing gap that ensures that dust-laden air will be forced to undergo at least one change of flow direction before entering the dust catching assembly.

3 Claims, 2 Drawing Sheets

FEATHER DUSTER HAVING A FAN ASSEMBLY

TECHNICAL FIELD OF THE INVENTION

The present invention relates to the general art of brushing and scrubbing and to the particular field of dusting implements.

BACKGROUND OF THE INVENTION

A general cleaning process often includes a step of removing dust and/or dirt from various surfaces. This step has used various devices ranging from a simple dust cloth to sophisticated air flow systems. Many of these devices have found some use and success in both industry and in the home.

Especially with regard to home use, the simple feather duster has long proved to be efficient and popular. The feather duster is especially useful in reaching out-of-the way areas, such as behind and on top of furniture.

However, it has been found that the feather duster really only moves dirt and dust from one location to another, and such displaced dust must still be picked up for removal. This drawback inhibits the fully efficient use of a very popular, and otherwise efficient, cleaning device.

If the dust is not efficiently moved, it will simply settle back onto either the original surface or onto another adjacent surface and have to be moved or picked up again.

Accordingly, there is a need for a feather duster which can efficiently remove dust as well as displace dust while ensuring that displaced dust will be efficiently directed to a dust-catching assembly for future disposal.

OBJECTS OF THE INVENTION

It is the main object of the present invention is to provide a feather duster which can efficiently remove dust.

It is another object of the present invention is to provide a feather duster which can efficiently remove dust as well as displace dust.

It is another object of the present invention is to provide a feather duster which can efficiently remove dust as well as displace dust while ensuring that displaced dust will be efficiently directed to a dust-catching assembly for future disposal.

It is another object of the present invention is to provide a feather duster which can efficiently remove dust as well as displace dust while ensuring that displaced dust will be efficiently directed to a dust-catching assembly for future disposal by including a turbulence-inducing area through which the dust-laden air must pass before entering a dust catching system so that dust will be thoroughly mixed with the air.

SUMMARY OF THE INVENTION

These, and other, objects are achieved by a feather duster which includes a dust catching system which traps the dust stirred up by the feathers of the feather duster. The dust-catching system includes a fan unit which co-operates with a dust-catching element via a bell-shaped conduit and with the feather section via a skirt assembly to move dust from the feather section to the dust-catching element. That element is removably mounted in the handle of the feather duster so it can be periodically cleaned.

The skirt assembly is designed to efficiently catch dust and move dust-laden air into the dust-catching system in a manner that ensures that dust will efficiently move in the desired direction toward the dust-catching assembly. Specifically, the skirt assembly includes a turbulence-inducing area in which the dust-laden air is thoroughly mixed so the dust does not tend to settle out of the air before that air can be moved into the dust catching system.

BRIEF DESCRIPTION OF THE DRAWING FIGURES

DETAILED DESCRIPTION OF THE PREFERRED EMBODIMENT OF THE INVENTION

Figure 1:
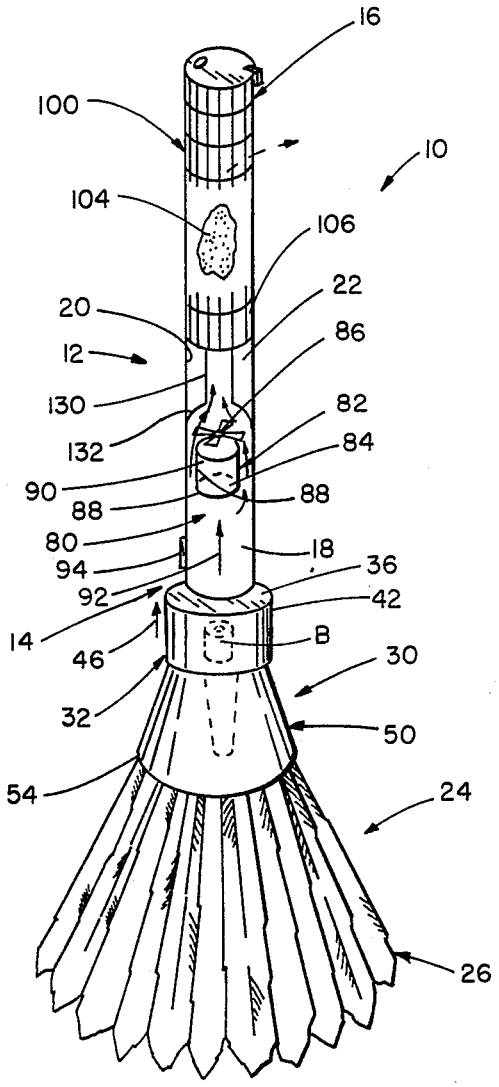
FIG. 1 is a perspective view of a feather duster embodying the present invention.

Shown in FIG. 1 is a feather duster 10 embodying the present invention. The feather duster 10 is able to move dust in the manner of a normal feather duster; however, the duster 10 has means for capturing the moved dust in an efficient manner so that dust need not be removed at a later time.

The feather duster 10 includes a hollow cylindrical handle 12 that has a first end 14 and a second end 16 that serves as the top end when the duster is in use. The hollow handle includes a cylindrical outer surface 18 and an inner surface 20 that defines a bore 22 that extends longitudinally of the handle. The handle preferably is made of sturdy material, such as aluminum, but can also be made of wood or the like.

A feather assembly 24 is attached to the first end of the handle, and includes a multiplicity of feathers, such as feather 26 that are used to stir up dust as the handle is moved. The feathers are attached to the handle by a skirt assembly 30 that is affixed to the handle first end.

The skirt assembly 30 not only serves to connect the feathers to the handle, it also serves as a battery case and as a means for controlling the flow of dust-laden air stirred up as the feathers are moved over a dusty surface.

Figure 3:
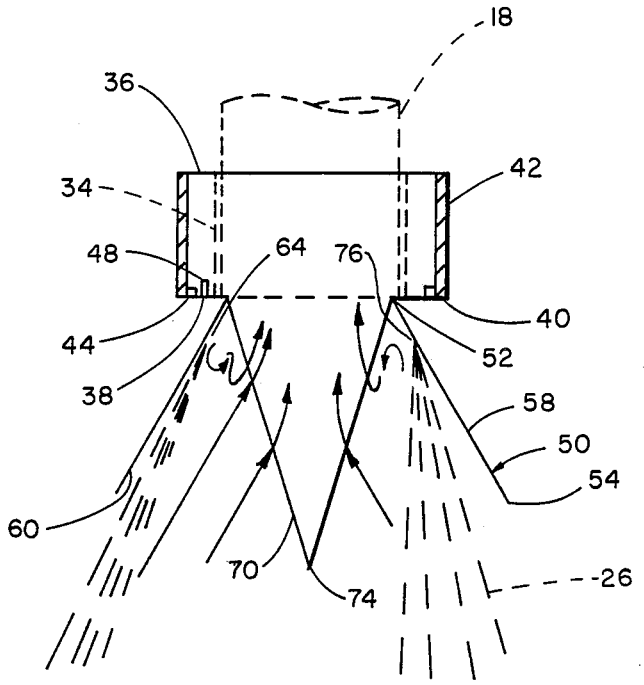
FIG. 3 is a sketch of a skirt assembly of the feather duster.

The skirt assembly 30 thus includes an annular battery case 32 surrounding and affixed to the handle adjacent to the first end 14. The battery case contains batteries, such as battery B, and is shown in FIGS. 1 and 3. The battery case includes an inner wall 34 affixed to the handle outer surface 18, a top wall 36 affixed to the handle outer surface and to the inner wall 34 and extending radially outwardly of that handle for a first radial distance. The case 32 also includes a bottom wall 38 fixed to the inner wall 34 and extending radially outwardly of the handle for a second radial extent that is greater than the first radial extent so that an annular "overhang" 40 is defined.

An outer wall 42 is cylindrical and has an inner radius that is greater than the outer radius of the top wall and an outer radius that is essentially equal to the outer radius of the bottom wall so that the outer wall can slide over the top wall into abutting contact with the bottom wall to close the battery case. The outer wall also includes a stop element 44 on the inner surface thereof, with the stop element being sized to abut the lower surface of the top wall to prevent the outer wall from being completely separated from the rest of the battery case when the outer wall is moved in the direction indicated by arrow 46 in FIG. 1.

The sliding nature of the outer wall permits the battery case to be opened to insert and remove batteries. The battery case also includes electrical contacts, such as contact 48, for electrically coupling the batteries into the remainder of a circuit to be described below.

As shown in FIG. 3, a frusto-conical air impermeable skirt 50 is attached at a frustum 52 thereof to the battery case bottom wall 38 and diverges downwardly therefrom to a lower edge 54 that is spaced from the frustum end along the longitudinal direction of the handle. The skirt has an outer surface 58 and an inner surface 60 and is hollow to be open at the bottom end thereof.

The feathers 26 are attached at the upper ends thereof to the inner surface of the skirt at a location that is spaced from the frustum as indicated at location 64 in FIG. 3. The purpose of this spacing will be discussed below.

Figure 2:
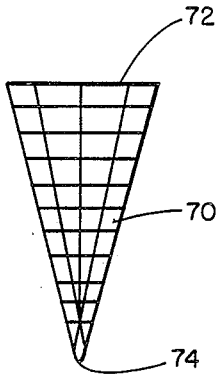
FIG. 2 is side elevational view of a conical air and dust screen used in the feather duster of the present invention.

A conical air and dust screen 70 is best shown in FIGS. 2 and 3, and is attached at a base end 72 thereof to the battery case bottom wall adjacent to the frustum 52. The screen 70 converges downwardly from the base to an apex 74 that is spaced from the base along the longitudinal direction of the handle.

The screen 70 is a mesh type screen having dust controlling capabilities as discussed in standard handbooks, such as "Marks' Standard Handbook for Mechanical Engineers, Seventh Edition", edited by T. Baumeister and published by McGraw-Hill Book Company in 1967, the disclosure of which is incorporated herein by reference.

As is best shown in FIG. 3, the screen 70 is displaced from the inner surface 60 of the skirt, and the displacement of the feather attachment point creates an annular gap 76 near the intersection of the skirt wall and the screen at the battery case bottom wall 38. This gap is triangular in cross section, and the purpose of this gap will be seen from the ensuing discussion.

Dust-laden air is moved through the duster 10 by a fan assembly 80, that is best shown in FIG. 1.

The fan assembly 80 includes a fan unit 82 having a motor unit 84 and a fan propeller unit 86, with the motor unit 84 being mounted on the handle inner surface 20 by a spider mount 88 to space that motor unit away from the inner surface 20 and define a by-pass for air to flow past the fan unit as indicated in FIG. 1 by the arrows 90. Air flow is thus from the feather assembly towards the handle second end as indicated by arrow 92 whereby air laden with dust and dirt that has been stirred up from a surface by movement of the feathers moves through the handle in direction 92.

The fan motor is connected to the batteries in the battery case via an on/off switch 94 to move the air as above described.

Figure 4:
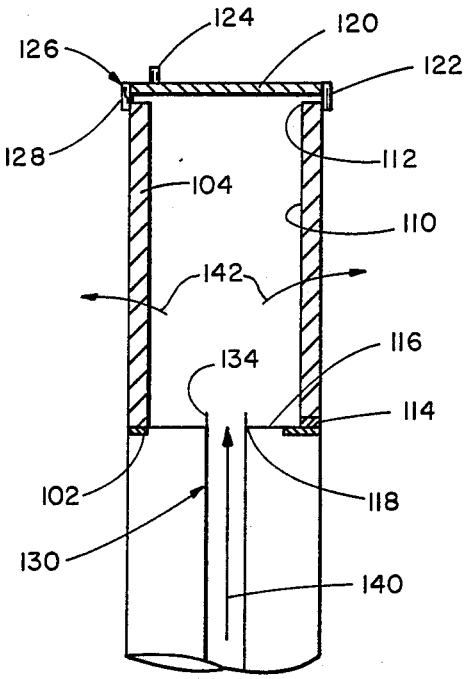
FIG. 4 is a sketch of a dust-catching assembly of the feather duster.

A dust catcher assembly 100 is best shown in FIGS. 1 and 4 and is located adjacent to the handle second end. The dust catcher assembly 100 includes an annular shoulder 102 mounted on the inner surface 20 of the handle to extend inward thereof for supporting a dust catching element 104, such as is used in vacuum cleaners, thereon inwardly adjacent to a dust screen 106 located in the handle subadjacent to the handle second end.

The dust catching element is cylindrical in shape and has a central bore 110 defined longitudinally therethrough from an open end 112 to a closed end 114. The closed end has an air impermeable plate 116 thereon which has a central opening 118 defined therethrough. The closed end of the dust catching element abuttingly rests on the shoulder 102 to be supported thereon. An air impermeable closure cap 120 is attached to the handle adjacent to the second end by a hinge element 122 to be opened and closed to gain access to the dust catching element to change and replace that dust catching element. The cover includes a handle 124 and a latch mechanism 126. The latch mechanism includes an element 128 that is hingeably connected to the handle to lock and unlock the closure cover.

A dust/air conduit 130 is best shown in FIGS. 1 and 4, and fluidically connects the fan to the bore 110 of the dust catching element to transfer dust-laden air from the handle interior into the dust-catching element bore 110. This conduit 130 includes a bell shaped fluid inlet end 132 that is fixedly mounted to the handle inner surface 20 superadjacent to the fan blades 86 to receive fluid therefrom. The conduit extends through the plate central hole 118 and includes an exit end 134 located inside the dust catching element bore 110.

Referring to FIGS. 1, 3 and 4, it can be seen that as the feathers stir up dust from a surface, this dust will be trapped in air that is moving towards the handle second end due to the influence of the fan assembly. This dust is then moved with the air upwards into the skirt assembly where it is thoroughly mixed with that air due to the turbulence caused at the gap 76. This turbulence-induced mixing ensures that the dust will not settle back out of the moving air before it is trapped inside the handle. As discussed above, if the dust settles back towards the surface before the air is moved into the handle, this dust will either be left behind or settle onto another area and have to be moved again, thereby vitiating the efficiency of the feather duster.

The dust-laden, turbulent air is then moved through the screen 70 and into the handle, past the fan unit via the bypass areas, and into the inlet end 132 of conduit 130. This air is then transferred by such conduit into the interior of the dust catching element as indicated in FIG. 4 by arrow 140. The air flow is then through the dust catching element, and out as indicated in FIG. 4 by arrows 142. The dust catching element can be periodically changed and cleaned by opening the closure cap 120 and removing such dust catching element.

It is understood that while certain forms of the present invention have been illustrated and described herein, it is not to be limited to the specific forms or arrangements of parts described and shown.

I claim:

1. A feather duster comprising:

(A) a hollow cylindrical handle having a first end and a second end and a bore defined longitudinally therethrough by a handle inner surface;

(B) a skirt assembly mounted on said handle first end and including (1) an annular battery case surrounding said handle and having an inner and an outer wall which are spaced apart from each other along a radial direction of said cylindrical handle, a top wall and a bottom wall which is spaced from said top wall along the handle longitudinal direction, said top wall extending outward from said handle for a first radial distance and said bottom wall extending outward of said handle for a second radial distance with is greater than said first radial distance, said inner wall being fixedly mounted on said handle and fixed to said battery case top and bottom walls, with said battery case outer wall slidably engaging said battery case top wall and abuttingly engaging said battery case bottom wall to define a battery compartment which is openable by sliding said battery case outer wall away from abutting engagement with said battery case bottom wall, said battery case further including electrical contacts therein, (2) a frusto-conical air impermeable skirt having a frustum end and being attached at said frustum end to said battery case bottom wall and having a wall diverging downwardly from said battery case bottom wall, said skirt being open on one end thereof which is spaced from said frustum end in the longitudinal direction of the handle, having an inner surface and an outer surface and being hollow, and (3) a conical air and dust screen having a base end and being attached at said base end to said battery case bottom wall and converging downwardly therefrom and being located inside said air impermeable skirt, said dust screen base end being connected to said air impermeable skirt wall;

(c) a multiplicity of feathers each attached at one end thereof to said skirt inner surface at an attachment location which is spaced from said frustum end to define an annular turbulence-inducing gap which is defined between the intersection of said frustum end and said battery case bottom wall and between the feather attachment location and the intersection between the skirt and the battery case bottom wall, with the gap being triangular in cross section, the feathers being oriented to diverge away from each other downwardly from the attachment location to define a hollow feather frusto-conical skirt which has an open distal end and an inner surface;

(D) a fan assembly mounted in said handle and being electrically connected to said battery electrical contacts, said fan assembly including (1) a fan oriented to direct air flow from said handle first end towards said handle second end, (2) a fan supporting spider element fixed to said handle inner surface and supporting said fan to be spaced from said handle inner surface to define a by-pass area between said fan and said handle inner surface, (3) said fan including fan blades located and oriented to cause air containing dust that has been stirred up from a surface by movement of the feathers to flow towards said frusto-conical skirt, said annular turbulence-inducing gap causing such dust-containing air to change flow direction and to be thoroughly mixed before passing into said air and dust screen;

(E) an on/off switch mounted on said handle and electrically connecting said fan unit to said battery electrical contacts;

(F) a dust catcher assembly mounted on said handle adjacent to said second end and including (1) an annular shoulder mounted on said handle inner surface and spaced from said handle second end, (2) an air permeable screen section extending from said annular shoulder to said handle second end, (3) a cylindrical dust-catching element releasably supported at one end thereof on said annular shoulder and having another end thereof located at said handle second end and having a central bore in fluid communication with said handle bore and an outer surface contacting and in fluid communication with said screen section, said dust-catching element one end including an annular air impermeable plate covering said dust-catching element central bore and having a central hold defined therethrough, said dust-catching element being open at another end thereof;

(G) a dust/air conduit fluidically connecting said fan to said dust-catching element and including an inlet end which is bell shaped and attached to said handle inner surface and located closely adjacent to said fan to receive dust-laden air from said fan, and an outlet end located adjacent to said dust catcher assembly annular shoulder to be received through said dust-catching element plate central hole to fluidically connect said dust-catching element central bore to said fan, said dust/air conduit extending into said dust-catching element central bore; and (H) an air impermeable closure cap hingeably mounted on said handle to cover said handle second end and said dust-catching element open end and including a catching-element mounted on said handle.

2. The feather duster defined in claim 1 wherein said battery case outer wall includes an annular stop shoulder thereon.

3. The feather duster defined in claim 2 wherein said fan blades are located closely adjacent to said air/dust conduit inlet end.

* * * * *